US011104362B2

(12) United States Patent
Hogan et al.

(10) Patent No.: US 11,104,362 B2
(45) Date of Patent: Aug. 31, 2021

(54) SYSTEM AND METHOD FOR CONTROLLING SIGNALING DEVICES ALONG RAILROAD TRACKS IN ELECTRIFIED TERRITORY

(71) Applicant: Siemens Inudstry, Inc., Alpharetta, GA (US)

(72) Inventors: Brian Joseph Hogan, Temecula, CA (US); A. Nathan Edds, La range, KY (US); Richard Bamfiield, Upper Moutere (NZ)

(73) Assignee: Siemens Mobility, Inc., New York, NY (US)

( * ) Notice: Subject to any disclaimer, the term of this patent is extended or adjusted under 35 U.S.C. 154(b) by 442 days.

(21) Appl. No.: 16/312,177

(22) PCT Filed: Jun. 24, 2016

(86) PCT No.: PCT/US2016/039166
§ 371 (c)(1),
(2) Date: Dec. 20, 2018

(87) PCT Pub. No.: WO2017/222544
PCT Pub. Date: Dec. 28, 2017

(65) Prior Publication Data

US 2019/0232989 A1 Aug. 1, 2019

(51) Int. Cl.
*B61L 23/16* (2006.01)

(52) U.S. Cl.
CPC ..... *B61L 23/168* (2013.01); *B61L 23/166* (2013.01)

(58) Field of Classification Search
CPC ..... B61L 23/168; B61L 23/166; B61L 1/188; B61L 1/187; B61L 21/10; B61L 3/221;
(Continued)

(56) References Cited

U.S. PATENT DOCUMENTS 4,065,081 A 12/1977 Huffman et al.
5,465,926 A * 11/1995 Brown ..... B61L 23/168 246/34 B (Continued)

FOREIGN PATENT DOCUMENTS

FR 2.205.029 * 6/1974
GB 2 208 449 * 3/1989
WO 2011009134 A2 1/2011

OTHER PUBLICATIONS

PCT International Search Report and Written Opinion of International Searching Authority dated Mar. 17, 2017 corresponding to PCT International Application No. PCT/US2016/039166 filed Jun. 24, 2016.

*Primary Examiner* — Mark T Le

(57) ABSTRACT

A system (100) and method is provided that facilitates controlling signaling devices along railroad tracks in electrified territory. The system may include a first track circuit transmitter (116) connectable to a first end (160) of a first block (162) of a railroad track (180). A first processor (104) may be configured to determine a first signaling aspect (112) corresponding to a visible light signal outputted by a first signaling device (110) and cause the first track circuit transmitter to transmit a first code (166) corresponding to the first signaling aspect via a first AC carrier signal (164) through rails (182, 184) of the first block of the railroad track. The system may also include a first track circuit receiver (134) connectable to a second end (168) of the first block of the railroad track, which is configured to receive the first AC carrier signal through the rails of the first block of the railroad track and demodulate the first code from the first AC carrier signal. A second processor (124) may be configured to determine a second signaling aspect (132) based at least in part on the first code that was demodulated and
(Continued)

cause a second signaling device (130) to output a visible signal corresponding to the second signaling aspect.

15 Claims, 3 Drawing Sheets

(58) Field of Classification Search
CPC ..... B61L 3/246; B61L 3/243; B61L 27/00; B61L 23/12
See application file for complete search history.

(56) References Cited

U.S. PATENT DOCUMENTS

| | | | | |
|---|---|---|---|---|
| 8,387,925 | B2 * | 3/2013 | Aisa | B61L 3/243 246/34 B |
| 2005/0075765 | A1 * | 4/2005 | Oguma | B61L 23/168 701/19 |
| 2009/0143928 | A1 | 6/2009 | Ghaly | |
| 2013/0334373 | A1 | 12/2013 | Malone, Jr. et al. | |

* cited by examiner

SYSTEM AND METHOD FOR CONTROLLING SIGNALING DEVICES ALONG RAILROAD TRACKS IN ELECTRIFIED TERRITORY

CROSS REFERENCE TO RELATED APPLICATIONS

This Application is the U.S. National Stage of International Application No. PCT/US2016/039166 filed 24 Jun. 2016, the content of which are herein incorporated by reference in its entirety.

TECHNICAL FIELD

The present disclosure is directed, in general, to track circuits used in the railroad industry to control signaling devices.

BACKGROUND

Signaling devices are used in the railroad industry along railroad tracks to provide visual information regarding track conditions to a locomotive engineer. Such a locomotive engineer may control the train based on such information in order to enable the train to safely stop short of an obstruction and/or safely handle potentially other dangerous conditions. Systems that operate signaling devices may benefit from improvements.

SUMMARY

Variously disclosed embodiments include systems and methods used to facilitate controlling signaling devices along railroad tracks in electrified territory. In one example, the system may comprise a first track circuit transmitter connectable to a first end of a first block of a railroad track in electrified territory. In addition the system may comprise a first processor configured to determine a first signaling aspect corresponding to a visible light signal outputted by a first signaling device and cause the first track circuit transmitter to transmit a first code corresponding to the first signaling aspect via a first AC carrier signal through rails of the first block of the railroad track. Also, the system may include a first track circuit receiver connectable to a second end of the first block of the railroad track, which is configured to receive the first AC carrier signal through the rails of the first block of the railroad track and demodulate the first code from the first AC carrier signal. Further, the system may include a second processor configured to determine a second signaling aspect based at least in part on the first code that was demodulated and cause a second signaling device to output a visible signal corresponding to the second signaling aspect.

In another example, a method for controlling signaling devices along railroad tracks in electrified territory may comprise acts carried out through operation of a first and second processor. The method may include through operation of a first processor: determining a first signaling aspect corresponding to a visible light signal outputted by a first signaling device; and causing a first track circuit transmitter connected to a first end of a first block of a railroad track in electrified territory to transmit a first code corresponding to the first signaling aspect via a first AC carrier signal through rails of the first block of the railroad track. In addition the method may include through operation of a second processor: determining a second signaling aspect based at least in part on the first code demodulated from the first AC carrier signal by a first track circuit receiver connected to a second end of the first block of the railroad track; and causing a second signaling device to output a visible light signal corresponding to the second signaling aspect.

A further example may include a non-transitory computer readable medium encoded with executable instructions (such as a firmware component on a storage device) that when executed, causes at least one processor to carry out this described method.

Another example may include an apparatus including at least one hardware, software, and/or firmware based processor, computer, controller, means, module, and/or unit configured to carry out functionality corresponding to this described method.

The foregoing has outlined rather broadly the technical features of the present disclosure so that those skilled in the art may better understand the detailed description that follows. Additional features and advantages of the disclosure will be described hereinafter that form the subject of the claims. Those skilled in the art will appreciate that they may readily use the conception and the specific embodiments disclosed as a basis for modifying or designing other structures for carrying out the same purposes of the present disclosure. Those skilled in the art will also realize that such equivalent constructions do not depart from the spirit and scope of the disclosure in its broadest form.

Also, before undertaking the Detailed Description below, it should be understood that various definitions for certain words and phrases are provided throughout this patent document, and those of ordinary skill in the art will understand that such definitions apply in many, if not most, instances to prior as well as future uses of such defined words and phrases. While some terms may include a wide variety of embodiments, the appended claims may expressly limit these terms to specific embodiments.

DETAILED DESCRIPTION

Figure 1:
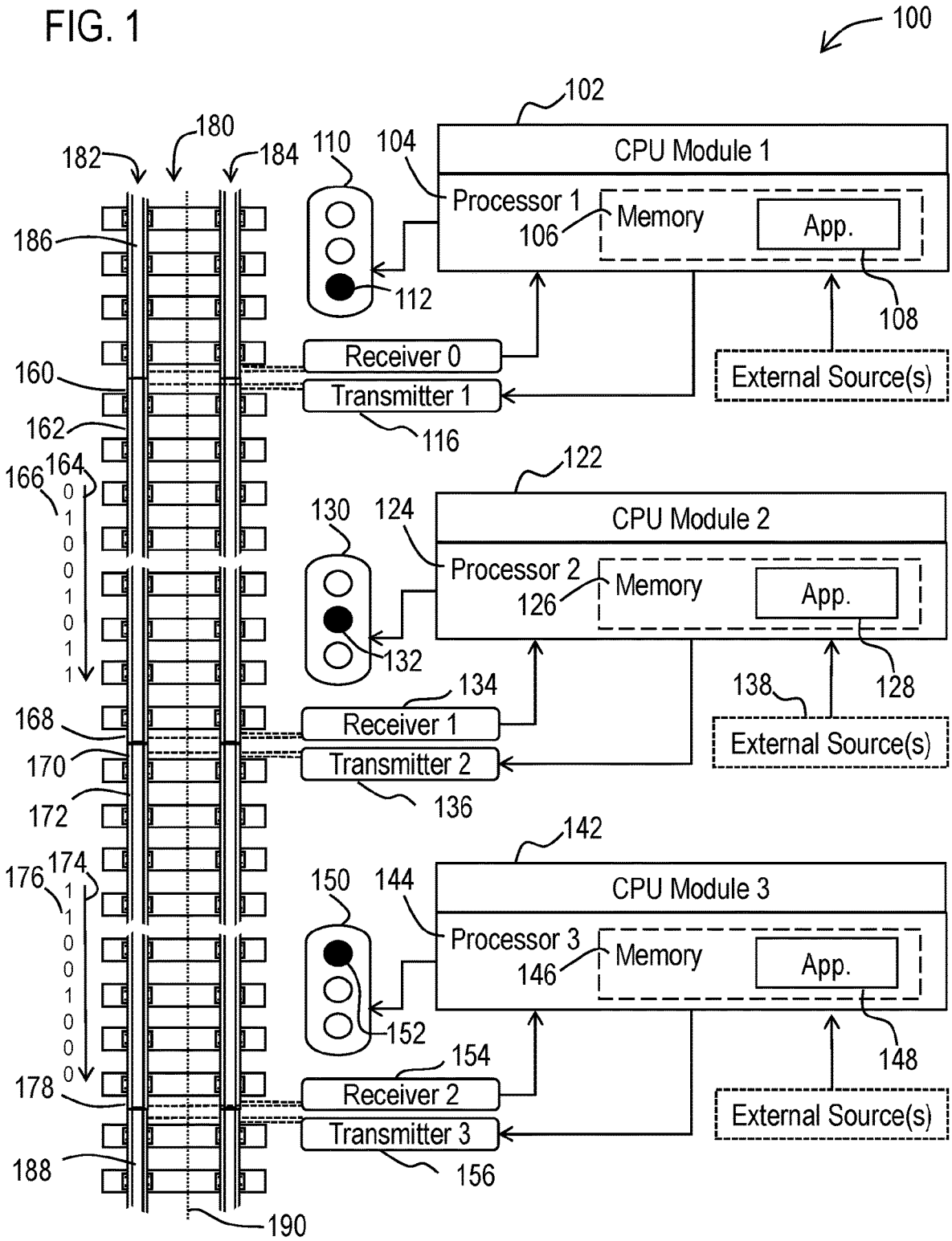
FIG. 1 illustrates a functional block diagram of an example system that facilitates controlling signaling devices along railroad tracks in electrified territory.

Various technologies that pertain to systems and methods that facilitate controlling signaling devices along railroad tracks in electrified territory will now be described with reference to the drawings, where like reference numerals represent like elements throughout. The drawings discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged apparatus. It is to be understood that functionality that is described as being carried out by certain system elements may be performed by multiple elements. Similarly, for instance, an element may be configured to perform functionality that is described as being carried out by multiple elements. The numerous innovative teachings of the present application will be described with reference to exemplary non-limiting embodiments.

An example embodiment corresponds to a system that is configured to communicate signaling aspects from one signaling device to another via components that are usable to detect the presence of a train in a block of a track in electrified territory. Such components may include an AC overlay track circuit including a transmitter and a receiver, with the transmitter configured to transmit an AC signal through the track rails at one end of a block of track and the receiver connected to the rails at the other end of the block and configured to detect the signal. Other than the connection through the track rails, there may typically be no connection between the transmitter and receiver for a block. When a train is present in a block of track monitored by such a track circuit, the train shunts, or shorts, the two rails, with the result that no signal is received at the receiver. Such components may thus be usable to detect Whether or not a train is present in the block based on the presence or absence of a detected signal.

In some embodiments, such transmitters may be capable of generating any one of the 16 different frequencies and 16 or more different 8 bit long codes, and the receivers may automatically detect any of the 16 frequencies and 16 or more codes. However, it should be appreciated that in other example embodiments, other numbers of frequencies and codes may be used.

Some embodiments may employ a binary frequency shift key (BFSK) technique to generate a carrier signal at a desired frequency and modulate the carrier signal with codes (or other digital data) in order to dynamically communicate codes from the transmitter to the receiver through a railroad track. The transmitter, for example, may include a signal generator/modulator that generates an AC carrier signal at a desired frequency and modulates the carrier signal with a code using BFSK modulation. Also, the receiver, for example, may include a tuner/demodulator that receives a BFSK signal transmitted via the rails by the transmitter and demodulates the code carried by the AC signal. Examples of encoding/decoding algorithms for a BFSK transmitter and receiver that may be used in example embodiments are discloses in U.S. Pat. No. 8,660,215 issued Feb. 25, 2014 and U.S. Pat. No. 8,590,844 issued Nov. 26, 2013, which are hereby incorporated herein by reference in their entirety. Also, examples of transmitter/receiver components that may be adapted to carry out described embodiments may include Siemens A80428 PSO module.

With reference to FIG. 1, an example system 100 is illustrated that facilitates controlling signaling devices 110, 130, 150 along a railroad track 180 in electrified territory using such components. In this example, the track includes two rails 182, 184. Also, FIG. 1 shows the track 180 being divided into several blocks including blocks 186, 162, 172, 188.

In some embodiments, the railroad track may include insulators at the boundaries of the blocks in order to electrically isolate them. However, it should be understood that the example embodiments described herein do not require insulators between sets of blocks. Thus, insulators may not be present between sets of blocks.

In such embodiments, the rails in adjacent blocks may be electrically coupled together such that each AC carrier signal passes through the rails of more than one block. Also, in such embodiments, different AC frequencies may be used by different sets of transmitters/receivers. Further, in some examples, the tracks may be of a type that is referred to in the art as jointless.

The described configuration is enabled to be used in electrified territory, which as defined herein corresponds to an additional electrified circuit 190 along the same railroad track 180 (through which the AC signals are communicated). Such an electrified circuit provides electrical power to operate the train and may correspond to a third rail or overhead catenary wires. For example, in some embodiments with a third rail, the return conductor for a DC current provided by a third rail may include the running rails through which the AC signals are communicated.

In example embodiments, transmitters 116, 136 and receivers 134,154, may be connected to the respective ends of each block of track. For example, the system may include a first track circuit transmitter 116 connectable to a first end 160 of a first block 162 of a railroad track 180. Also, the system may include a first track circuit receiver 134 connectable to a second end 168 of the first block of the railroad track. Each of the receiver and transmitter may be connected to both rails 182, 184 of the first block 162, (via electrical cables or other conductors) in order to form a closed circuit.

In some example embodiments, the receivers and the transmitters adjacent ends of adjacent blocks, may be packaged as separate circuit cards with a physical communications link between them, housed in a common chassis. However, in other example embodiments, the circuitry associated with an adjacent receiver and transmitter may be integrated into a common circuit card and mounted in a chassis or other housing. Also, it should be appreciated that in other example embodiments, the receivers and transmitters may be located in other locations and/or may be mounted in different locations from each other.

The example system 100 may also include a first processor 104 and a second processor 124. Such processors may be included in separate CPU modules 102,122 (i.e., data processing systems) located respectively adjacent the ends of the first block. Each CPU module may also include a memory 106, 126 and at least one application component 108, 128 executable from the memory in the respective first and second processors 104, 124.

As defined herein, a processor corresponds to any electronic device that is configured via hardware circuits, software, and/or firmware to process data. For example, processors described herein may correspond to one or more (or a combination) of a microprocessor, CPU, FPGA, ASIC, or any other integrated circuit (IC) or other type of circuit that is capable of processing data and carrying out the various functions described herein. A processor in the form of a microprocessor, for example, may be configured to execute at least one application component 108, 128 (such as a firmware or software) from the memory 106, 126. The application component may be configured (i.e., programmed) to cause the processor to carry out various acts and functions described herein.

In an example embodiment, the CPU modules may be substantially identical with respect to hardware and the application component. For example, they may include a copy of the same application component and may include the same hardware ports for connecting to the various other devices described herein (e.g., receivers, transmitters, signaling devices). Differences between CPU modules may include how the modules are configured via confirmation data stored therein (e.g., in a non-volatile memory). For example, different modules may be configured such that connected receivers and transmitters communicate codes through different respective blocks of railroad tracks using different frequencies for an AC carrier signal. However, it should be understood that CPU modules along a railroad track may be implemented with different hardware and/or application components that are capable of communicating codes in a manner that are compatible with each other. An example of a CPU module that may be adapted for use in at least some of the examples described herein includes a Siemens A80903 CPUIII module.

In an example embodiment, the first processor 104 may be configured to determine a first signaling aspect 112 corresponding to a visible light signal outputted by a first signaling device 110. For example, the first CPU module may be configured to control the signaling device 110 via a data cable or other interface and thus may store in memory data representative of the current signaling aspect that the CPU module has used to operate the signaling device. Thus, the first processor may be operative to determine the current signaling aspect from its memory. However, in other example embodiments, the first processor may communicate with the signaling device 130 to determine the currently signaling aspect outputted by the signaling device.

In example embodiments, a signaling aspect corresponds to the particular type of visible light signal (or absence of a light signal) that is being provided by the signaling device. For example, signaling devices (which may include one light source, or a collection of different light sources) may be capable of outputting different colors of light which represent information useful to a locomotive engineer in the operation of a train. In particular, the various different colors, symbol, numbers, or other visible outputs capable of being outputted by a signaling device correspond to different signaling aspects and convey to the locomotive engineer different relative speeds for the train to operate on the current block of railroad track and/or what they are to expect at the next signal location.

For example, in the U.S. different signaling aspects may correspond to: normal speed (i.e., maximum authorized speed); limited speed which is less than normal speed such as between 40 miles/hr (64 km/hr) and 60 miles/hr (97 km/hr); medium speed, which may be relatively lower than the limited speed such as between 30 miles/hr (48 km/hr) and 40 miles/hr (64 km/hr); slow speed, which may be relatively lower than the limited or medium speeds, such as 20 miles/hr (32 km/hr); restricted speed, which may be no greater than 20 miles/hr (32 km/hr); and zero speed (e.g., train stop).

Railroads may employ a number of different types of signaling devices to output visible light signals corresponding to these different signaling aspects. Examples, include searchlight signals, triangular color light signals, vertical color light signals, position light signals, and color position light signals.

For example, the output of a red colored light may correspond to a first signaling aspect representative of an instruction to stop the train (i.e., a zero velocity). Also, an output of a yellow colored light may correspond to a second signaling aspect representative of an instruction to proceed at a reduced nonzero speed (relative to a normal speed for the train at the current location on the railroad track such as a limited, medium, low speed). In addition, a green colored light may correspond to a third signaling aspect representative of an instruction to proceed at the normal maximum authorized speed, which is typically relatively higher than the speed associated with a yellow light signaling aspect for the location of the train on the railroad track.

It should also be appreciated that different railroad tracks (which may be operated by the same or a different railroad) may use other, different, and more levels of signaling aspects to represent instructions for different relative levels of speed. Other examples include numbers that specify a maximum speed. Other examples include additional or alternative colors, such as a lunar (blue filtered) white signal to indicate a restricted proceed condition. Also, the absence of a color may also correspond to a signaling aspect that is equivalent to a green signaling aspect.

Even though a block of a railroad track may be on the order of several miles or kilometers, it should be appreciated that a large train may require more than one block of train track to slow from a maximum authorized speed to a stop condition. Thus, to inform a locomotive engineer that an upcoming block is associated with a red light (full stop signaling aspect), the example system may be configured to communicate the presence of the red light signaling aspect to one or more intermediate blocks of the train track (between the train and the red light signal), to enable signaling devices at the intermediate blocks to convey the need to lower the speed of the locomotive.

An example first CPU module associated with one block may thus communicate a signaling aspect associated with a signaling device from that block to a second CPU module associated with an adjacent block through the rails of the track. The second CPU module may then cause an associated signaling device to begin displaying a signaling aspect that warns the locomotive engineer to slow the train down with a signaling aspect that represents a speed that is relatively higher than the signaling aspect received by the second CPU module, but lower than the previous signaling aspect for the signaling device.

For example, with reference to FIG. 1, the first processor 104 (in the first CPU module 102) may cause the first track circuit transmitter 116 to transmit a first code 166 corresponding to the first signaling aspect 112 via a first AC carrier signal 164 through the rails 182, 184 of the first block 162 of the railroad track 180. Such a first signaling aspect 112 may correspond to a full stop signaling aspect such as typically conveyed by a red colored light from the signal device 110.

The first track circuit receiver 134 (connected to the second CPU module 122) connected to a second end 168 of the first block of the railroad track, may be configured to receive the first AC carrier signal through the rails of the first block 162 and demodulate the first code 166 from the first AC carrier signal 164. The second processor 124 (included in the second CPU module 122) may be configured to determine a second signaling aspect 132 based at least in part on the first code that was demodulated.

For example, the first processor may be configured to select the first code to transmit that corresponds to the first signaling aspect from a plurality of different codes. Also, the second processor may be configured to determine that the demodulated first code corresponds to the first signaling aspect from among the plurality of different signaling aspects and based thereon cause the second signaling aspect to be different than the first signaling aspect.

Such a second signaling aspect 132, for example, may correspond to a medium speed signaling aspect such as conveyed by a yellow colored light. Based on the determined second signaling aspect, the processor may then cause a second signaling device 130 to output a visible light signal corresponding to the determined second signaling aspect.

In example embodiments, each signaling aspect of a plurality of different signaling aspects may be associated with a different code (such as an 8 bit code) that can be communicated from a transmitter to a receiver. Thus, the first processor and the second processor may be configured to determine correspondence between each of plurality of different signaling aspects and each of a plurality of different codes transmittable between the first track circuit transmitter and receiver via a table stored in memory, a configuration file, data stored in the application component, and/or, Boolean logic, a formula, and/or any other process capable of translating between signaling aspects and codes transmittable through a block of track.

In example embodiments where the first signaling aspect (determined by the second CPU module from a transmitted code) corresponds to information that regulates train speed, the second processor may be configured to determine the second signaling aspect from the plurality of signaling aspects based on the first signaling aspect such that the second signaling aspect corresponds to a train speed that is faster than a train speed corresponding to the first signaling aspect. Thus, if the first signaling aspect corresponds to a red signal, the determined second signaling aspect may be determined to correspond to the next higher speed signaling aspect such as a yellow signal (which causes the signaling device to change from outputting green to yellow light for example). Likewise, if the first signaling aspect corresponds to a yellow signal, the determined second signaling aspect may be determined to correspond to the next higher speed signaling aspect such as a green signal (which causes the signaling device to remaining outputting a green light for example).

Also in example embodiments, some CPU modules may be configured to operate differently based on physical characteristics of the particular block of train track, such as the length and/or inclination of the block. For example, in cases where the block of train track is relatively short or declines sharply, the CPU module may be configured to determine that the second signaling aspect matches the first signaling aspect. Thus for example, the second signaling aspect may be determined to correspond to the first signaling aspect for cases when the first signaling aspect corresponds to a red signal. Also for example, in cases where the block of train track is relatively longer or inclines sharply, the CPU module may be configured to determine that the second signaling aspect should not change based on the particular type of first signaling aspect. Thus for example, the second signaling aspect may be determined to remain corresponding to a green signal, in cases where the first signaling aspect corresponds to a red signal. Also, it should be appreciated that the CPU module may be configured such that for one of the first signaling aspects the second signaling aspect may match the first signaling aspect, whereas for other first signaling aspects, the second signaling aspect may be different.

In addition, in example embodiments, the CPU module may be configured to operate a signaling device based on additional information received by the CPU module. For example, with respect to FIG. 1, the second processor 124 may be configured to determine the second signaling aspect based at least in part on information from an external source 138 other than the first track circuit receiver. Such a source, for example, may include a sensor associated with the train track that is configured to detect adverse environmental conditions, such as excessive ice or snow. Such a source, for example, may include a signal provided through a wired or wireless network form a remote controller that interfaces with CPU modules along the rail road track and which specifies particular signaling aspects for the CPU module to output through their respective signaling devices.

In example embodiments, the CPU module may further be configured to determine a signaling aspect based on both information received from an external source and the code received by an associated receiver. For example, the second CPU module may determine that the second signaling aspect corresponds to lower speed signaling aspect from among the signaling aspects determined from the received code through the railroad track or the received information from an external source. Further, the CPU modules may determine appropriate signaling aspects based at least in part on other information or data received by the receivers such as the presence of another train on another block of train track.

It should be noted that signaling aspects may be communicated from block to block for a sequence of several blocks along a railroad track from one CPU module to another via codes transmitted through the railroad track using different AC carrier signals in each block. For example, as illustrated in FIG. 1, the system 100 may include a second track circuit transmitter 136 connectable to a first end 170 of a second block 172 of the railroad track. The second processor 124 (of the second CPU module) may be configured to cause the second track circuit transmitter to transmit a second code 176 corresponding to the second signaling aspect via a second AC carrier signal 174 through rails of the second block of the railroad track.

In addition, the system 100 may include a third processor 144 (in a third CPU module 142) and a second track circuit receiver 154 connectable to a second end 178 of the second block of the railroad track. The second track circuit receiver may be configured to receive the second AC carrier signal 174 through the rails 182, 184 of the second block of the railroad track and demodulate the second code from the second AC carrier signal. The third processor 144 may then be configured to determine a third signaling aspect 152 based at least in part on the second code that was demodulated and cause a third signaling device 150 to output a visible light signal corresponding to the third signaling aspect.

As with the other CPU modules, the third CPU module 142 may also include a memory 146 and at least one application component 148, executable from the memory in the third processor 144. The application component 148 may have the same functionality and/or may be a copy of the application components 108, 128 found in the other CPU modules. Also, as with the previously described CPU modules, the third CPU module may be configured to cause a further track circuit transmitter 156 to transmit a further code correspond to the third signaling aspect through the rails of a further block 188 of track.

FIG. 1 schematically illustrates only one receiver or transmitter on each end of each block. However, it should be understood that an implementation of the described system may include both a receiver and a transmitter on each end of each block that are configured to enable bi-directional communication of signaling aspects. Also in further embodiments, the receivers may be configured to detect a plurality of AC carrier signals (and associated codes) transmitted from transmitters associated with non-adjacent blocks (i.e., blocks that are one or more blocks away from an adjacent signaling device. In such embodiments, a CPU module may be configured to base the determination as to what signaling aspect to output through a signaling device based on signaling aspects associated with signaling devices more than one block away from the location of the receiver and associated CPU module.

Figure 2:
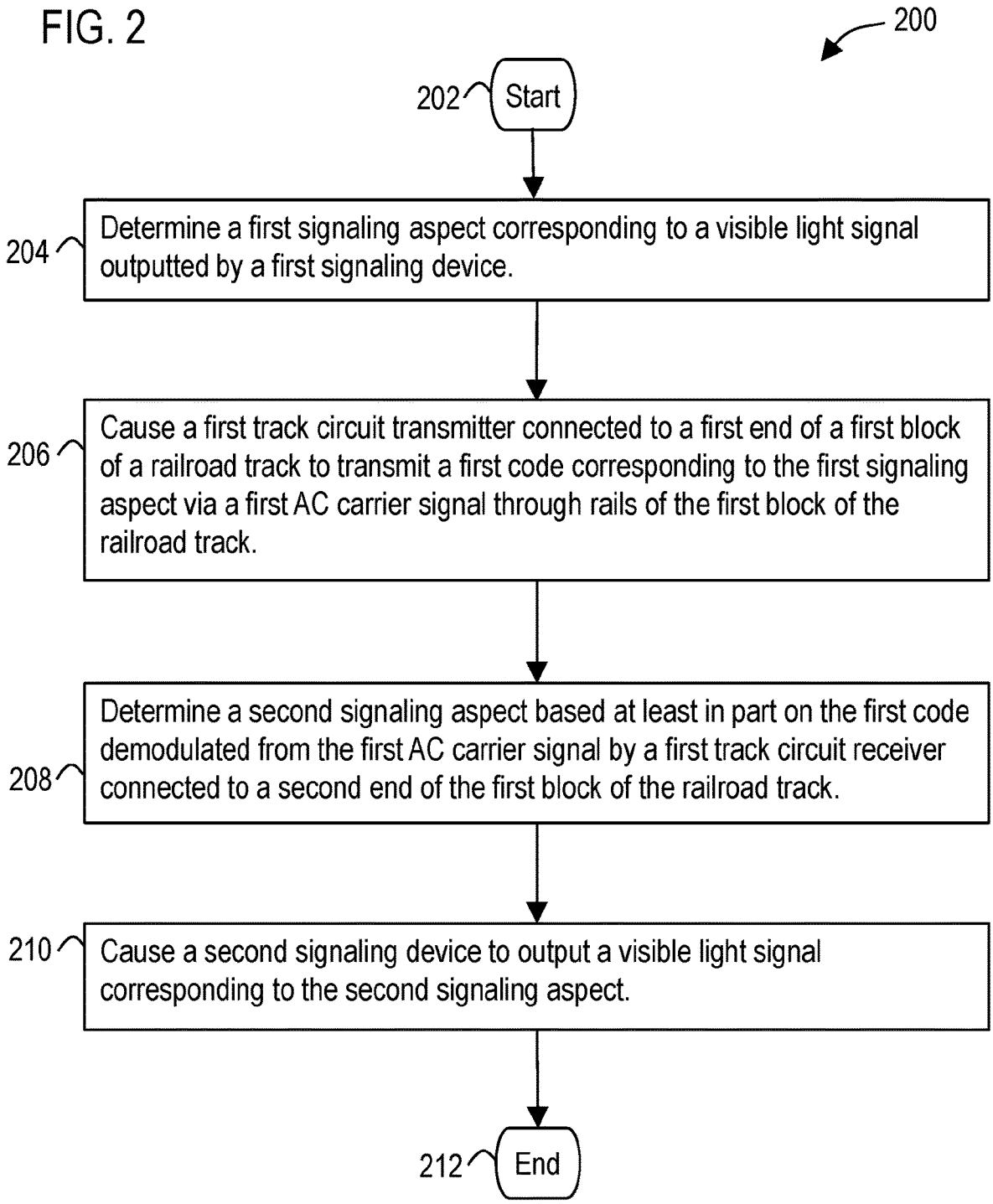
FIG. 2 illustrates a flow diagram of an example methodology that facilitates controlling signaling devices along railroad tracks in electrified territory.

With reference now to FIG. 2, various example methodologies are illustrated and described. While the methodologies are described as being a series of acts that are performed in a sequence, it is to be understood that the methodologies may not be limited by the order of the sequence. For instance, some acts may occur in a different order than what is described herein. In addition, an act may occur concurrently with another act. Furthermore, in some instances, not all acts may be required to implement a methodology described herein.

It is important to note that while the disclosure includes a description in the context of a fully functional system and/or a series of acts, those skilled in the art will appreciate that at least portions of the mechanism of the present disclosure and/or described acts are capable of being distributed in the form of computer-executable instructions contained within non-transitory machine-usable, computer-usable, or computer-readable medium in any of a variety of forms, and that the present disclosure applies equally regardless of the particular type of instruction or data bearing medium or storage medium utilized to actually carry out the distribution. Examples of non-transitory machine usable/readable or computer usable/readable mediums include: ROMs, EPROMs, hard disk drives, SSDs, flash memory, optical disks. The computer-executable instructions may include a routine, a sub-routine, programs, applications, modules, libraries, and/or the like. Still further, results of acts of the methodologies may be stored in a computer-readable medium, displayed on a display device, and/or the like.

Referring now to FIG. 2, a methodology 200 is illustrated that facilitates controlling signaling devices along railroad tracks. The method may start at 202 and the methodology may include several acts carried out through operation of a first and second processor.

These acts may include through operation of a first processor, an act 204 of determining a first signaling aspect corresponding to a visible light signal outputted by a first signaling device, and act 206 of causing a first track circuit transmitter connected to a first end of a first block of a railroad track to transmit a first code corresponding to the first signaling aspect via a first AC carrier signal through rails of the first block of the railroad track. In addition the method may include through operation of a second processor, an act 208 of determining a second signaling aspect based at least in part on the first code demodulated from the first AC carrier signal by a first track circuit receiver connected to a second end of the first block of the railroad track, and an act 210 of causing a second signaling device to output a visible light signal corresponding to the second signaling aspect. At 212 the methodology may end.

It should be appreciated that the methodology 200 may include other acts and features discussed previously with respect to the system 100. For example, the first processor and the second processor may be configured to determine correspondence between a plurality of different signaling aspects and a plurality of different codes transmittable between the first track circuit transmitter and receiver. The methodology may then include an act of through operation of the first processor, selecting the first code to transmit that corresponds to the first signaling aspect from the plurality of different codes. In addition the methodology may include an act of through operation of the second processor, determining that the demodulated first code corresponds to the first signaling aspect from among the plurality of different signaling aspects and based thereon causing the second signaling aspect to be different than the first signaling aspect.

In addition, the example methodology 200 may further comprise through operation of the second processor an act of determining the second signaling aspect based on information from a source other than the first track circuit receiver. As discussed previously, such sources may include one or more sensors providing an indication of dangerous conditions along the railroad track. Also such a source may originate from an external operator (via a wireless or wired network) that oversees signaling along the railroad track.

In example embodiments, the first processor and an application component may be included in a first module in operable connection with the first signaling device. Also the second processor and the same application component (e.g., a copy thereof) may be included in a second module in operable connection with the second signaling device. Such an application component executing in the first processor may cause the first processor to determine the first signaling aspect and cause the first track circuit transmitter to transmit the first code. Such an application component executing in the second processor may be configured to cause the second processor to determine the second signaling aspect based at least in part on the first code and cause the second signaling device to output the visible light signal corresponding to the second signaling aspect.

The described methodology may also include through operation of the second processor, an act of causing a second track circuit transmitter connected to a first end of a second block of the railroad track to transmit a second code corresponding to the second signaling aspect via a second AC carrier signal through the second block of the railroad track. In addition the methodology may include through operation of a third processor, an act of determining a third signaling aspect based at least in part on the second code demodulated from the second AC carrier signal by a second track circuit receiver connected to a second end of the second block of the railroad track, and an act of causing a third signaling device to output a visible light signal corresponding to the second signaling aspect.

In these described examples, the electrified territory corresponds to an electrified circuit along the first and second blocks of the railroad track that provides electrical power to a train. Such an electrified circuit for example may include a third rail or a catenary wire.

Also, it should be appreciated that in at least some examples, the railroad track may not include insulators between the first and second blocks of the railroad track. In such examples, the first and second AC carrier signals travel through both the first and second blocks of the railroad track and the first AC carrier signal and the second AC carrier signal are different AC frequencies.

In example embodiments of the methodology, the act of determining the second signaling aspect may include determining the second signaling aspect from the plurality of signaling aspects based on the first signaling aspect such that the second signaling aspect corresponds to a train speed that is faster than a train speed corresponding to the first signaling aspect.

For example, in an example methodology, the plurality of signaling aspects may include a red light signal, a yellow light signal, and a green light signal. Determining the second signaling aspect may include determining the second signaling aspect from the plurality of signaling aspects based on the first signaling aspect such that the second signaling aspect corresponds to a yellow light signal based on the first code corresponding to a first signaling aspect corresponding to a red light signal. Thus in this example, the act of causing the second signaling device to output a visible light signal may include the second processor causing the second signal device to change from outputting a green light signal to outputting a yellow light based on the determined second signaling aspect.

As discussed previously, acts associated with these methodologies (other than any described manual acts) may be carried out by one or more processors. Such processor(s) may be included in one or more data processing systems (e.g., the described modules, transmitters, receivers) and may correspond to a microcontroller that executes firmware or software (such as the described application component) operative to cause these acts to be carried out by the one or more processors. Such firmware or software may comprise computer-executable instructions corresponding to a routine, a sub-routine, programs, applications, modules, libraries, a thread of execution, and/or the like. Further, it should be appreciated that software components may be written in and/or produced by software environments/languages/frameworks such as C, C #, C++ or any other software tool capable of producing components configured to carry out the acts and features described herein.

Figure 3:
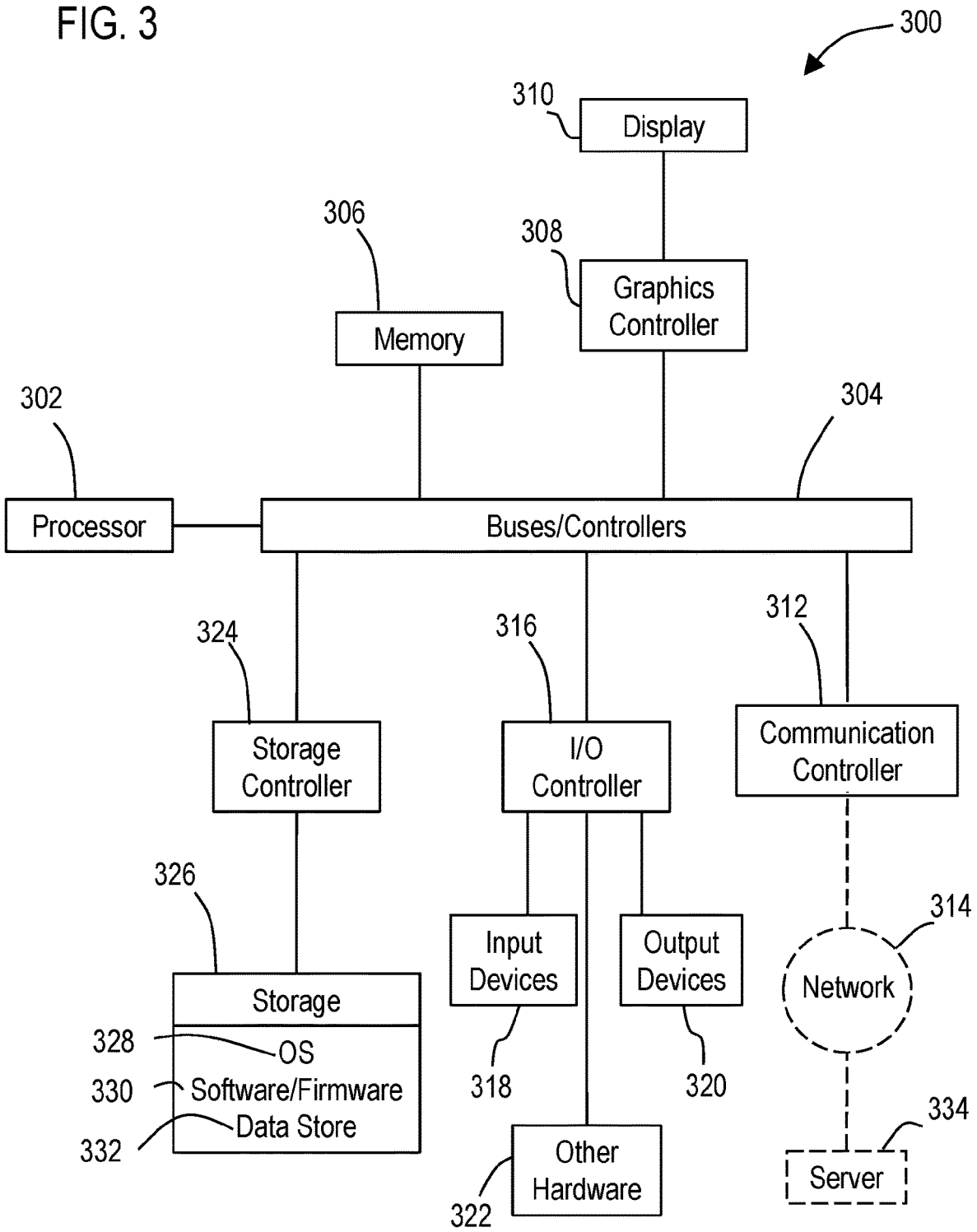
FIG. 3 illustrates a block diagram of a data processing system that may be use to implement embodiments of the example system and method.

However, it should be appreciated that the described processors may correspond to any type of data processing system capable of carrying out the described examples. In this regard, FIG. 3 illustrates a block diagram of generic example of a data processing system 300 which may be used in some example embodiments. The data processing system depicted includes at least one processor 302 (e.g., a CPU) that may be connected to one or more bridges/controllers/buses 304 (e.g., a north bridge, a south bridge). One of the buses 304, for example, may include one or more I/O buses such as a PCI Express bus. Also connected to various buses in the depicted example may include a main memory 306 (RAM) and in some embodiments a graphics controller 308. The graphics controller 308 may be connected to one or more display devices 310. It should also be noted that in some embodiments one or more controllers (e.g., graphics, south bridge) may be integrated with the CPU (on the same chip or die). Examples of CPU architectures include IA-32, x86-64, and ARM processor architectures.

Other peripherals connected to one or more buses may include communication controllers 312 (Ethernet controllers, WiFi controllers, cellular controllers) operative to connect to a local area network (LAN), Wide Area Network (WAN), a cellular network, and/or other wired or wireless networks 314 or communication equipment.

Further components connected to various busses may include one or more I/O controllers 316 such as USB controllers, Bluetooth controllers, and/or dedicated audio controllers (connected to speakers and/or microphones). It should also be appreciated that various peripherals may be connected to the I/O controller(s) (via various ports and connections) including input devices 318 (e.g., keyboard, mouse, pointer, touch screen, touch pad, drawing tablet, trackball, buttons, keypad, game controller, gamepad, camera, microphone, scanners, motion sensing devices that capture motion gestures), output devices 320 (e.g., printers, speakers) or any other type of device that is operative to provide inputs to or receive outputs from the data processing system. Also, it should be appreciated that many devices referred to as input devices or output devices may both provide inputs and receive outputs of communications with the data processing system. For example, the processor 302 may be integrated into a housing (such as a tablet) that includes a touch screen that serves as both an input and display device. Further, it should be appreciated that some input devices (such as a laptop) may include a plurality of different types of input devices (e.g., touch screen, touch pad, and keyboard). Also, it should be appreciated that other peripheral hardware 322 connected to the I/O controllers 316 may include any type of device, machine, or component that is configured to communicate with a data processing system.

Additional components connected to various busses may include one or more storage controllers 324 (e.g., SATA). A storage controller may be connected to a storage device 326 such as one or more storage drives and/or any associated removable media, which can be any suitable non-transitory machine usable or machine readable storage medium. Examples, include nonvolatile devices, volatile devices, read only devices, writable devices, ROMs, EPROMs, magnetic tape storage, floppy disk drives, hard disk drives, solid-state drives (SSDs), flash memory, optical disk drives (CDs, DVDs, Blu-ray), and other known optical, electrical, or magnetic storage devices drives and/or computer media. Also in some examples, a storage device such as an SSD may be connected directly to an I/O bus 304 such as a PCI Express bus.

A data processing system in accordance with an embodiment of the present disclosure may include an operating system 328, software/firmware 330, and data stores 332 (that may be stored on a storage device 326 and/or the memory 306). Such an operating system may employ a command line interface (CLI) shell and/or a graphical user interface (GUI) shell. The GUI shell permits multiple display windows to be presented in the graphical user interface simultaneously, with each display window providing an interface to a different application or to a different instance of the same application. A cursor or pointer in the graphical user interface may be manipulated by a user through a pointing device such as a mouse or touch screen. The position of the cursor/pointer may be changed and/or an event, such as clicking a mouse button or touching a touch screen, may be generated to actuate a desired response. Examples of operating systems that may be used in a data processing system may include Microsoft Windows, Linux, UNIX, iOS, and Android operating systems. Also, examples of data stores include data files, data tables, relational database (e.g., Oracle, Microsoft SQL Server), database servers, or any other structure and/or device that is capable of storing data, which is retrievable by a processor.

The communication controllers 312 may be connected to the network 314 (not a part of data processing system 300), which can be any public or private data processing system network or combination of networks, as known to those of skill in the art, including the Internet. Data processing system 300 can communicate over the network 314 with one or more other data processing systems such as a server 334 (also not part of the data processing system 300). However, an alternative data processing system may correspond to a plurality of data processing systems implemented as part of a distributed system in which processors associated with several data processing systems may be in communication by way of one or more network connections and may collectively perform tasks described as being performed by a single data processing system. Thus, it is to be understood that when referring to a data processing system, such a system may be implemented across several data processing systems organized in a distributed system in communication with each other via a network.

Further, the term "controller" means any device, system or part thereof that controls at least one operation, whether such a device is implemented in hardware, firmware, software or some combination of at least two of the same. It should be noted that the functionality associated with any particular controller may be centralized or distributed, whether locally or remotely.

In addition, it should be appreciated that data processing systems may be implemented as virtual machines in a virtual machine architecture or cloud environment. For example, the processor 302 and associated components may correspond to a virtual machine executing in a virtual machine environment of one or more servers. Examples of virtual machine architectures include VMware ESCi, Microsoft Hyper-V, Xen, and KVM.

Those of ordinary skill in the art will appreciate that the hardware depicted for the data processing system may vary for particular implementations. For example, the data processing systems in the example system 100 may correspond to microprocessors and/or controllers. However, it should be appreciated that in alterative embodiments, data processing systems may include other types of data processing systems including a server, and/or any other type of apparatus/system that is operative to process data and carry out functionality and features described herein associated with the operation of a data processing system, computer, processor, module, and/or a controller discussed herein. The depicted example is provided for the purpose of explanation only and is not meant to imply architectural limitations with respect to the present disclosure.

Also, it should be noted that the processor described herein may be located in a server that is remote from the display and input devices described herein. In such an example, the described display device and input device may be included in a client device that communicates with the server (and/or a virtual machine executing on the server) through a wired or wireless network (which may include the Internet). In some embodiments, such a client device, for example, may execute a remote desktop application or may correspond to a portal device that carries out a remote desktop protocol with the server in order to send inputs from an input device to the server and receive visual information from the server to display through a display device. Examples of such remote desktop protocols include Teradici's PCoIP, Microsoft's RDP, and the RFB protocol. In such examples, the processor described herein may correspond to a virtual processor of a virtual machine executing in a physical processor of the server.

As used herein, the terms "component" and "system" are intended to encompass hardware, software, or a combination of hardware and software. Thus, for example, a system or component may be a process, a process executing on a processor, or a processor. Additionally, a component or system may be localized on a single device or distributed across several devices.

Also, as used herein a processor corresponds to any electronic device that is configured via hardware circuits, software, and/or firmware to process data. For example, processors described herein may correspond to one or more (or a combination) of a microprocessor, CPU, FPGA, ASIC, or any other integrated circuit (IC) or other type of circuit that is capable of processing data in a data processing system, which may have the form of a controller board, computer, server, and/or any other type of electronic device.

Those skilled in the art will recognize that, for simplicity and clarity, the full structure and operation of all data processing systems suitable for use with the present disclosure is not being depicted or described herein. Instead, only so much of a data processing system as is unique to the present disclosure or necessary for an understanding of the present disclosure is depicted and described. The remainder of the construction and operation of data processing system 300 may conform to any of the various current implementations and practices known in the art.

Also, it should be understood that the words or phrases used herein should be construed broadly, unless expressly limited in some examples. For example, the terms "include" and "comprise," as well as derivatives thereof, mean inclusion without limitation. The singular forms "a", "an" and "the" are intended to include the plural forms as well, unless the context clearly indicates otherwise. Further, the term "and/or" as used herein refers to and encompasses any and all possible combinations of one or more of the associated listed items. The term "or" is inclusive, meaning and/or, unless the context clearly indicates otherwise. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Also, although the terms "first", "second", "third" and so forth may be used herein to describe various elements, functions, or acts, these elements, functions, or acts should not be limited by these terms. Rather these numeral adjectives are used to distinguish different elements, functions or acts from each other. For example, a first element, function, or act could be termed a second element, function, or act, and, similarly, a second element, function, or act could be termed a first element, function, or act, without departing from the scope of the present disclosure.

In addition, phrases such as "processor is configured to" carry out one or more functions or processes, may mean the processor is operatively configured to or operably configured to carry out the functions or processes via software, firmware, and/or wired circuits. For example, a processor that is configured to carry out a function/process may correspond to a processor that is executing the software/firmware, which is programmed to cause the processor to carry out the function/process and/or may correspond to a processor that has the software/firmware in a memory or storage device that is available to be executed by the processor to carry out the function/process. It should also be noted that a processor that is "configured to" carry out one or more functions or processes, may also correspond to a processor circuit particularly fabricated or "wired" to carry out the functions or processes (e.g., an ASIC or FPGA design). Further the phrase "at least one" before an element (e.g., a processor) that is configured to carry out more than one function may correspond to one or more elements (e.g., processors) that each carry out the functions and may also correspond to two or more of the elements (e.g., processors) that respectively carry out different ones of the one or more different functions.

In addition, the term "adjacent to" may mean: that an element is relatively near to but not in contact with a further element; or that the element is in contact with the further portion, unless the context clearly indicates otherwise.

Although an exemplary embodiment of the present disclosure has been described in detail, those skilled in the art will understand that various changes, substitutions, variations, and improvements disclosed herein may be made without departing from the spirit and scope of the disclosure in its broadest form.

None of the description in the present application should be read as implying that any particular element, step, act, or function is an essential element, which must be included in the claim scope: the scope of patented subject matter is defined only by the allowed claims. Moreover, none of these claims are intended to invoke a means plus function claim construction unless the exact words "means for" are followed by a participle.

What is claimed is:

1. A system for controlling signaling devices along railroad tracks in an electrified territory comprising:

a first track circuit transmitter connectable to a first end of a first block of a railroad track in the electrified territory;

a first processor configured to determine a first signaling aspect corresponding to a visible light signal outputted by a first signaling device and cause the first track circuit transmitter to transmit a first code corresponding to the first signaling aspect via a first AC carrier signal through rails of the first block of the railroad track;

a first track circuit receiver connectable to a second end of the first block of the railroad track, which is configured to receive the first AC carrier signal through the rails of the first block of the railroad track and demodulate the first code from the first AC carrier signal; and a second processor configured to determine a second signaling aspect based at least in part on the first code that was demodulated and cause a second signaling device to output a visible light signal corresponding to the second signaling aspect.

2. The system according to claim 1, wherein the first processor and the second processor are configured to determine correspondence between a plurality of different signaling aspects and a plurality of different codes transmittable between the first track circuit transmitter and receiver, wherein the first processor is configured to select the first code to transmit that corresponds to the first signaling aspect from the plurality of different codes, wherein the second processor is configured to determine that the demodulated first code corresponds to the first signaling aspect from among the plurality of different signaling aspects and based thereon cause the second signaling aspect to be different than the first signaling aspect.

3. The system according to claim 2, further comprising:

a first module operable to connect to the first signaling device, which includes the first processor and an application component configured to cause the first processor to determine the first signaling aspect and cause the first track circuit transmitter to transmit the first code; and a second module operable to connect to the second signaling device, which includes the second processor and a copy of the same application component, which is further configured to cause the second processor to determine the second signaling aspect based at least in part on the first code and cause the second signaling device to output the visible light signal corresponding to the second signaling aspect.

4. The system according to claim 3, further comprising:

a second track circuit transmitter connectable to a first end of a second block of the railroad track;

wherein the second processor is configured to cause the second track circuit transmitter to transmit a second code corresponding to the second signaling aspect via a second AC carrier signal through rails of the second block of the railroad track;

a second track circuit receiver connectable to a second end of the second block of the railroad track, which is configured to receive the second AC carrier signal through the rails of the second block of the railroad track and demodulate the second code from the second AC carrier signal; and a third processor configured to determine a third signaling aspect based at least in part on the second code that was demodulated and cause a third signaling device to output a visible light signal corresponding to the third signaling aspect.

5. The system according to claim 4, wherein the electrified territory includes an electrified circuit along the first and second blocks of the railroad track that provides electrical power to a train, which electrified circuit includes a third rail or a catenary wire.

6. The system according to claim 5, wherein the railroad track does not include insulators between the first and second blocks of the railroad track, wherein the first and second AC carrier signals travel through both the first and second blocks of the railroad track, wherein the first AC carrier signal and the second AC carrier signal are different AC frequencies.

7. The system according to claim 6, wherein the second processor is configured to determine the second signaling aspect from the plurality of signaling aspects based on the first signaling aspect such that the second signaling aspect corresponds to a train speed that is faster than a train speed corresponding to the first signaling aspect, wherein the plurality of signaling aspects include a red light signal, a yellow light signal, and a green light signal, wherein the second processor is configured to determine the second signaling aspect from the plurality of signaling aspects based on the first signaling aspect such that the second signaling aspect corresponds to a yellow light signal based on the first code corresponding to a first signaling aspect corresponding to a red light signal, wherein the second processor is configured to cause the second signal device to change from outputting a green light signal to outputting a yellow light based on the determined second signaling aspect.

8. A method for controlling signaling devices along railroad tracks in electrified territory comprising:

through operation of a first processor:

determining a first signaling aspect corresponding to a visible light signal outputted by a first signaling device; and causing a first track circuit transmitter connected to a first end of a first block of a railroad track in electrified territory to transmit a first code corresponding to the first signaling aspect via a first AC carrier signal through rails of the first block of the railroad track; and through operation of a second processor:

determining a second signaling aspect based at least in part on the first code demodulated from the first AC carrier signal by a first track circuit receiver connected to a second end of the first block of the railroad track; and causing a second signaling device to output a visible light signal corresponding to the second signaling aspect.

9. The method according to claim 8, wherein the first processor and the second processor are configured to determine correspondence between a plurality of different signaling aspects and a plurality of different codes transmittable between the first track circuit transmitter and receiver, further comprising:

through operation of the first processor, selecting the first code to transmit that corresponds to the first signaling aspect from the plurality of different codes;

through operation of the second processor, determining that the demodulated first code corresponds to the first signaling aspect from among the plurality of different signaling aspects and based thereon causing the second signaling aspect to be different than the first signaling aspect.

10. The method according to claim 9, wherein a first module in operable connection with the first signaling device includes the first processor and an application component configured to cause the first processor to determine the first signaling aspect and cause the first track circuit transmitter to transmit the first code, wherein a second module in operable connection with the second signaling device includes the second processor and a copy of the same application component, which is further configured to cause the second processor to determine the second signaling aspect based at least in part on the first code and cause the second signaling device to output the visible light signal corresponding to the second signaling aspect.

11. The method according to claim 10, further comprising:

through operation of the second processor:

causing a second track circuit transmitter connected to a first end of a second block of the railroad track to transmit a second code corresponding to the second signaling aspect via a second AC carrier signal through rails of the second block of the railroad track; and through operation of a third processor:

determining a third signaling aspect based at least in part on the second code demodulated from the second AC carrier signal by a second track circuit receiver connected to a second end of the second block of the railroad track; and causing a third signaling device to output a visible light signal corresponding to the second signaling aspect.

12. The method according to claim 11, wherein the electrified territory includes an electrified circuit along the first and second blocks of the railroad track that provides electrical power to a train, which electrified circuit includes a third rail or a catenary wire.

13. The method according to claim 12, wherein the railroad track does not include insulators between the first and second blocks of the railroad track, wherein the first and second AC carrier signals travel through both the first and second blocks of the railroad track, wherein the first AC carrier signal and the second AC carrier signal are different AC frequencies.

14. The method according to claim 9, wherein determining the second signaling aspect includes determining the second signaling aspect from the plurality of signaling aspects based on the first signaling aspect such that the second signaling aspect corresponds to a train speed that is faster than a train speed corresponding to the first signaling aspect, wherein the plurality of signaling aspects include a red light signal, a yellow light signal, and a green light signal, wherein determining the second signaling aspect includes determining the second signaling aspect from the plurality of signaling aspects based on the first signaling aspect such that the second signaling aspect corresponds to a yellow light signal based on the first code corresponding to a first signaling aspect corresponding to a red light signal, wherein causing the second signaling device to output a visible light signal includes the second processor causing the second signal device to change from outputting a green light signal to outputting a yellow light based on the determined second signaling aspect.

15. A non-transitory computer readable medium encoded with executable instructions that when executed, cause the first and second processors to carry out the method according to claim 8.

* * * * *